United States Patent [19]
Vautrin et al.
[11] 4,247,291
[45] Jan. 27, 1981

[54] CONDITIONING OF TEXTURIZED FILAMENT YARNS

[75] Inventors: Helmut Vautrin, Hattersheim; Gustav Dollinger, Egelsbach, both of Fed. Rep. of Germany

[73] Assignee: Hoechst Aktiengesellschaft, Fed. Rep. of Germany

[21] Appl. No.: 42,977

[22] Filed: May 29, 1979

[30] Foreign Application Priority Data

Jun. 1, 1978 [DE] Fed. Rep. of Germany ..... 2823982

[51] Int. Cl.[3] ..... D06P 5/02; D06M 13/46
[52] U.S. Cl. ..... 8/495; 8/900; 252/8.8
[58] Field of Search ..... 8/73, 18 R

[56] References Cited

U.S. PATENT DOCUMENTS 3,752,649 8/1973 Smerz et al. ..... 8/73

*Primary Examiner*—William F. Hamock
*Attorney, Agent, or Firm*—Connolly and Hutz

[57] ABSTRACT

Process for conditioning texturized filament yarns, which comprises treating the yarn, after dyeing, with a fatty acid hydroxyalkylethylene diamine condensation product obtained by condensation of 1 mol of hydroxyethyl- or hydroxypropylethylene diamine with 1.2 to 1.8 mols of one or several $C_{12-22}$ fatty acids at 160° to 220° C.

1 Claim, No Drawings

CONDITIONING OF TEXTURIZED FILAMENT YARNS

The present invention relates to the conditioning or preparation of texturized filament yarns.

Texturized filament yarns for knitwear of polyamide and polyester are in great demand because of their easy-care properties and the great variety of application possiblities thereof. Filament yarns of this type are texturized in off-white state on special machines and, if required, dyed subsequently. In order to enable a flawless processing of this material on the knitting machine, a fiber conditioning with spooling oils is required in any case. Off-white filament yarn is conditioned with spooling oils continuously after the texturization on the texturizing machine. Dyed filament yarn, after dyeing, is successively conditioned with a softener in the final rinsing bath and dried. It is only during re-spooling on the winding frame from the dye spool onto the knitting spool that the filament yarn is conditioned with the spooling oil, in this case.

The spooling oils used in the above processes substantially consist of ester and mineral oils. They must be removed by washing after knitting, this step, however, involving difficulties due to the water-insolubility of the spooling oils. The spooling oil extracted by washing moreover highly pollutes the waste water. A further disadvantage involved in the use of spooling oils resides in the fact that with the required high amount applied thereof of about 3%, relative to the fiber weight, the color fastness is deteriorated by migration during prolonged storage. Finally spooling oils of minor quality may cause corrosion of the needles of the knitting machine.

U.S. Pat. No. 4,095,941 discloses condensation products of hydroxyalkyl- or hydroxypropylethylene diamine and fatty acids as conditioning agent for the manufacture of synthetic staple fibers having a marked separating capability.

It has now been found surprisingly not only that these condensation products are suitable for conditioning texturized filament yarns but also that they are capable of replacing the spooling oils hitherto required during processing. This is the more astonishing insofar as the described product gave rise to a loosening of the flock when used as initial conditioning agent for synthetic staple fibers. In the present case, however, an effect to the contrary is achieved: The texturized filament yarn is strengthened in its state so that it can be processed more conveniently and the additional use of spooling oils can be dispensed with.

Object of the present invention, consequently, is a process for the improved conditioning of texturized filament yarns, which comprises treating the yarn after dyeing with a fatty acid hydroxyalkylethylene diamine condensation product obtained by condensation at 160° to 220° C. of 1 mol of hydroxyethyl- or hydroxypropylethylene diamine with 1.2 to 1.8 mols of one or several $C_{12-22}$ fatty acids.

The fatty acid hydroxyalkylethylene diamine condensation products used as conditioning or preparation agent in the process of the invention are of the type disclosed in U.S. Pat. No. 4,095,941. They are obtained by reacting 1 mol hydroxyethyl- or hydroxypropylethylene diamine at a temperature from 160° to 220° C., preferably from 180° to 220° C., with 1.2 to 1.8, preferably 1.3 to 1.5, mols of one or several $C_{12-22}$, preferably $C_{14-20}$ fatty acid(s). Subsequently, the pH is adjusted to a slightly acid value with a water-soluble acid. These condensation products substantially present as imidazolinium compounds are added to the final rinsing bath as final conditioning agent in the form of an about 20% aqueous emulsion, after dyeing of the filament yarns. Generally from 2 to 4 g/l of this 20% emulsion are used with a goods-to-liquor ratio from 1:7 to 1:20. This gives an amount of active substance applied from about 0.4 to 0.6 weight %. The filament yarns to be conditioned in particular consist of polyamide and polyester.

After dyeing and conditioning the filament yarn is re-spooled with the winding frame onto the knitting spool without further conditioning, when dyeing has been carried out on a cylindrical dyeing spool. However, re-spooling may be dispensed with when the filament yarn is dyed direct on a conical spool. In both cases the dyed material is further processed on a circular knitting machine. A great advantage of the conditioning agent in conformity with the present invention resides in the fact that the knitted goods need not be submitted to washing after knitting. They are fixed direct and decated, since the condensation products used do not impair the utilitarian properties of the knitted goods.

The above specified conditioning agent free from oil signifies a considerable improvement for conditioning, since washing in the final conditioning of the knitted goods may be dispensed with. Thus, the conditioning costs are reduced considerably and oil, which might pollute the waste water, is not obtained.

The conditioning agent free from oil moreover has the advantage that the conditioned yarns cause no corrosion of the needles of the knitting machine and that a migration in the knitting spool, which would impair the fastness properties does not occur.

The following example illustrate the invention:

EXAMPLE 1

Texturized polyamide-6 filament yarn of dtex 20 to 200 is conditioned, after dyeing, in the final rinsing bath for 15 to 20 minutes with 2 to 4 g/l of 1-(β-stearoylethyl)-2-stearyl-imidazolinium acetate with a goods-to-liquor ratio from 1:7 to 1:20 and at a temperature from about 45 to 50° C. Subsequently, the water is removed and the material is dried. After drying, the yarn is re-spooled by means of the winding frame from the dyeing spool (muff) onto the knitting spool, followed by processing on the circular knitting machine. The knitted goods are steamed without washing on the tenter frame and fixed for 30 seconds at 150° C. at an overfeeding rate of 10%. Finally the knitted goods are decated.

EXAMPLE 2

Texturized polyester filament yarn of dtex 30 to 250 is submitted to a reductive aftertreatment after dyeing and subsequently conditioned in the final rinsing bath for 15 to 20 minutes with 2 to 4 g/l of the product described in Example 1 with a goods-to-liquor ratio from 1:7 to 1:20 at a temperature from about 45° to 50° C. The further processing is analogous to that of Example 1. Fixation of the knitted goods is carried out at an overfeeding rate of from 10 to 15% for 30 seconds at 175° to 180° C.

EXAMPLE 3

Texturized polyamide-6 and polyester filament yarns of dtex 20 to 250 are conditioned as described in Examples 1 and 2, except that after texturizing they are wound up on a conical spool, instead of a cylindrical spool (muff). The filament yarns are left on this conical spool to be further processed on the circular knitting machine without re-spooling.

The knitted goods are steamed as described above and fixed subsequently.

What is claimed is:

1. Process for conditioning texturized filament polyester and polyamide yarns, which comprises treating the yarn, after dyeing, with a fatty acid hydroxyalkylethylene diamine condensation product obtained by condensation of 1 mol of hydroxyethyl- or hydroxypropylethylene diamine with 1.2 to 1.8 mols of one or several $C_{12-22}$ fatty acids at 160° to 220° C.

* * * * *